United States Patent [19]

Stursa

[11] Patent Number: 4,645,288

[45] Date of Patent: Feb. 24, 1987

[54] PRINTED CIRCUIT BOARD COAXIAL CONNECTOR INTERFACE

[75] Inventor: Lloyd C. Stursa, Owatonna, Minn.

[73] Assignee: E. F. Johnson Company, Waseca, Minn.

[21] Appl. No.: 677,912

[22] Filed: Dec. 4, 1984

[51] Int. Cl.[4] ..... H01R 17/18

[52] U.S. Cl. ..... 339/177 R; 339/17 C; 339/217 R

[58] Field of Search ..... 339/17 C, 17 LC, 177 R, 339/177 E, 285 R, 143 R, 217 R

[56] References Cited

U.S. PATENT DOCUMENTS

| | | | |
|---|---|---|---|
| 2,869,090 | 1/1959 | Johanson | 339/17 C |
| 3,012,307 | 12/1961 | Felts | 339/17 C |
| 3,179,912 | 4/1965 | Huber et al. | 339/17 C |
| 3,243,760 | 3/1966 | Dupre et al. | 339/153 |
| 3,264,599 | 8/1966 | Kinkaid | 339/17 LC |
| 3,910,665 | 10/1975 | Stull | 339/17 C |
| 4,012,095 | 3/1977 | Doucet et al. | 339/17 C |
| 4,025,142 | 5/1977 | Huber et al. | 339/17 C |
| 4,119,359 | 10/1978 | Schultz | 339/177 R |
| 4,219,251 | 8/1980 | Romine | 339/17 C |
| 4,360,244 | 11/1982 | Forney, Jr. et al. | 339/177 R |
| 4,396,244 | 8/1983 | Teman | 339/17 C |
| 4,412,717 | 11/1983 | Monroe | 339/258 R |

FOREIGN PATENT DOCUMENTS

| | | |
|---|---|---|
| 2348689 | 9/1973 | Fed. Rep. of Germany . |
| 2047012 | 11/1980 | United Kingdom . |

*Primary Examiner*—Gil Weidenfeld
*Assistant Examiner*—David Pirlot
*Attorney, Agent, or Firm*—Dorsey & Whitney

[57] ABSTRACT

A miniature interface is provided that allows connection of a coaxial connector, used to terminate a coaxial cable, to a printed circuit board. The interface comprises a hollow tubular conductive body portion having a dielectric disposed therein and legs depending from a flange at the lower end of the body portion. When in place, the legs extend through holes in the circuit board, but the body portion rests above the circuit board on pads located on the lower surface of the flange. The pads serve to isolate the conductive body portion from the circuit board and allow solder to flux be washed out after a wave soldering process is used to affix the interface to the printed circuit board.

5 Claims, 3 Drawing Figures

PRINTED CIRCUIT BOARD COAXIAL CONNECTOR INTERFACE

BACKGROUND OF THE INVENTION

1. Field of the Invention

The present invention relates to a miniature coaxial cable connector interface for interconnecting a standard SMB coaxial connector, used to terminate a coaxial cable, to a printed circuit board having a standard SMB mounting pattern. More specifically, the present invention relates to an interface for such an application that isolates the connector body, and therefore, the outer braid of the coaxial cable, from the printed circuit board.

2. Background Art

It is frequently necessary to connect a coaxial cable to a printed circuit board. In so doing, it is advantageous to be able to disconnect the coaxial cable from the circuit board without having to undo the solder connection. Thus, it is advantageous to be able to connect a coaxial cable to a printed circuit board in a detachable fashion, for instance, by utilizing an interface between the printed circuit board and the coaxial cable terminator or connector. The interface should be solderable to the printed circuit board but also be detachably connectable to a mating coaxial connector attached to a coaxial cable.

Although attachment of a coaxial cable connector to a printed circuit board has been accomplished in a number of ways, it would be especially advantageous to have an interface which could be used with standard SMB components, such as coaxial connectors and printed circuit board mounting patterns. The prior art has been lacking in this regard.

Not only must such an interface be miniature, it must meet adequate performance requirements, such as operation into the gigahertz range. An excellent way to improve the performance of any coaxial device is to increase the degree of isolation between parts. More particularly, it is desirable to increase the degree of isolation between the outer braid of the cable and its attendant circuitry on the printed circuit board, and the center contact of the cable and its attendant strip line conductor located on the printed circuit board. Often times, coaxial connectors designed for printed circuit board use allow the body portion of the connector to rest directly on the circuit board thereby increasing the possibility of electrical connection between the strip line conductor running to the center contact and the other circuitry running to the grounded body portion of the connector.

To date, coaxial connectors for printed circuit board use have not been designed to ensure the necessary degree of isolation between the two conductors in a coaxial system. Thus, an interface that can be used for connecting a standard SMB coaxial connector to a printed circuit board having a standard SMB mounting pattern, that provides for a greater degree of isolation between the printed circuit board circuitry and the interface, and that provides these benefits at lower cost and at smaller scale, would be greatly welcomed.

SUMMARY OF THE INVENTION

The present invention contemplates an interface used to connect a coaxial cable connector to printed circuit board circuitry, within the realm of standard military specifications. The connector consists of a hollow tubular conductive body portion having a flange surrounding its lower end. Disposed inside of the body portion is a dielectric having a center contact. Spaced about the lower surface of the periphery of the flange are four legs depending downwardly. Also located on the lower surface of the flange are small pads so that when the interface is connected to the printed circuit board, by extending the legs and the center contact through holes in the board, the pads cause the flange and the body portion to ride above the surface of the printed circuit board. Thus, the body portion, connected to the outer braid of the coaxial cable, is isolated by air from the surface of the printed circuit board.

The dielectric is held in the body portion and prevented from moving upwardly or downwardly by an annular ring on the inner diameter of the body portion. The upper section of the body portion is designed to mate with a suitable standard military coaxial connector. A groove about the circumference of the body portion serves to latch into place a detent on the mating coaxial connector to secure the connector, the interface, and, consequently, the printed circuit board, together.

Size and cost are reduced over the invention's machined counterparts by diecasting the majority of the parts used in the invention. The invention may also be machined however. Furthermore, the invention improves the performance of coaxial connector-to-printed circuit board connections by greatly increasing isolation between conductors.

DESCRIPTION OF THE PREFERRED EMBODIMENT

Figure 1:
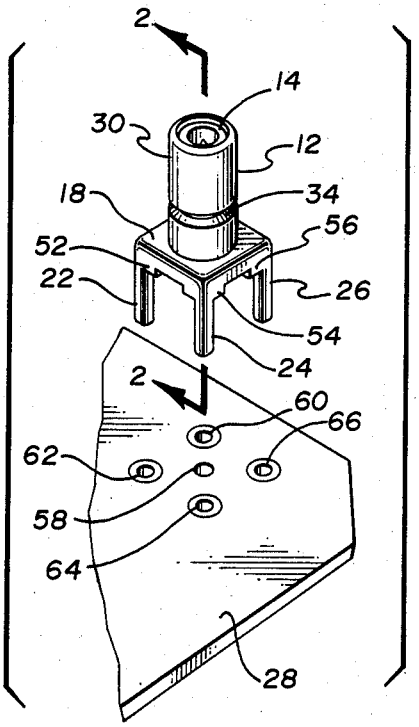
FIG. 1 is a perspective view of a coaxial connector printed circuit board interface and a circuit board in accordance with the present invention.

Referring to the drawings, a printed circuit board coaxial connector interface 10 in accordance with the present invention broadly includes a hollow tubular conductive body portion 12, a dielectric 14 disposed therein, a center contact 16 disposed in the dielectric, a flange 18 surrounding the lower edge of the body portion 12, and mounting legs 20, 22, 24, 26 extending from the lower surface of the flange 18. The circuit board 28 is also shown, but is devoid of any circuitry thereon for reasons of clarity.

The hollow tubular conductive body portion 12 is diecast in a cylindrical shape. The outer wall 30 of the body portion 12 is substantially perpendicular to the flange 18 located at the lower end of the body portion 12. The outer wall 30 of the body portion 12 has a groove 34 about its outer perimeter and an annular ring 32 about its interior, both just below the midway point of the body portion.

The dielectric 14 is disposed in the body portion 12 and extends from the upper end of the body portion to the lower end of the body portion. The dielectric 14 has a space in its uppermost portion as defined by interior dielectric walls 40 and 42. The space in the dielectric 14 extends to a point not quite halfway down the body portion 12, to the dielectric floor 42. The space in the dielectric 14 is circular in cross section as defined by the dielectric sidewall 40. The outer circumference of the dielectric 14 is also circular in cross section and has a groove 43 just below the midway point of the body portion 12 adjacent the annular ring 32. The body portion 12 is circular in cross section.

The center contact pin 16 is an elongated member running centrally through the longitudinal axis of the dielectric 14 and, consequently, of the body portion 12. The center contact 16 is comprised of a large diameter portion 46 which extends from a point substantially below the end of the body portion 12, past the flange 18, up to a point about midway through the dielectric 14. The large diameter portion 46 has small circular flanges 48 surrounding it. The circular flanges 48 extend outwardly from the circumference of the large diameter portion 46 of the center contact 16 a small distance in relation to the overall diameter of the center contact 16. The center contact 16 also has a smaller diameter portion 44 at its upper end which terminates in a point 45 near the uppermost end of the body portion 12. The transition point between the large diameter portion 46 and the smaller diameter portion 44 occurs at roughly the interior dielectric floor 42 mentioned above.

On the lower most surface 38 of the flange 18 are pads 50, 52, 54, and 56. One pad is located at each corner of the square flange 18. The pads extend downwardly from the lower surface 38 of the flange 18 a distance roughly one-half times the thickness of the flange 18. The pads 50, 52, 54, and 56 are square, and are small in relation to the overall size of the flange 18. The two outermost sides of each of the pads 50, 52, 54, and 56 are flush with the corners of the flange 18. The pads are diecast integrally with the body portion 12 and the flange 18.

Extending from the pads 50, 52, 54, and 56 are the legs 20, 22, 24, and 26. The leg 20 extends from the pad 50, the leg 22 extends downwardly from the pad 52, leg 24 from the pad 54, and, finally, the leg 26 extends downwardly from the pad 56. The distance that the legs extend downwardly from the pad is substantial in relation to the overall height of the connector 10. In fact, the legs 20, 22, 24, and 26 are nearly the same length as is the body portion 12. In addition, the legs extend downwardly from the body portion 12 the same distance as does the center contact 16. The legs are integrally diecast with the body, flange, and pads. Alternatively, these parts may be machined and the center contact 16 may extend beyond the legs.

Referring particularly to FIG. 1, the printed circuit board 28 is shown directly below the connector 10. The circuit board has, in it, holes 58, 60, 62, 64, and 66. The hole 58 is surrounded on four sides by the holes 60, 62, 64, and 66. The center hole 58 is a typical through-hole in a printed circuit board having conductive material on the wall which forms it and on the area on the lower surface of the printed circuit board (not shown) immediately adjacent to the hole 58. The other holes 60, 62, 64, and 66 likewise have conductive material on the walls forming them and on both the top and bottom surface of the printed circuit board immediately adjacent those holes. The holes 60, 62, 64, and 66 are connected to the printed circuit board ground plane, whereas the hole 58 runs to a signal-carrying strip line conductor. It should be noted that the mounting holes in the printed circuit board 28 are a standard SMB mounting pattern. Likewise, the legs 20, 22, 24, and 26, and the pads 50, 52, 54, and 56 are a standard SMB arrangement.

In use, the connector 12 sits upright on the printed circuit board 28. The legs 20, 22, 24, and 26 extend through the holes 60, 62, 64, and 66 respectively. The legs extend below the circuit board 28 and are soldered to the conductive contacts surrounding the holes 60, 62, 64, and 66 on the lower surface of the printed circuit board 28. The soldering provides both mechanical and electrical integrity with the printed circuit board. The solder 68, which secures the connector 10 to the printed circuit board 28, is shown in FIG. 2 as are the conductive portions 70 surrounding the holes 62 and 60.

The center contact 16 extends through the center hole 58 about the same distance as do the legs 20, 22, 24, and 26 through the holes 60, 62, 64, and 66. The center contact is soldered to the wall defining the hole 58 in the printed circuit board 28. Due to the unique structure of the connector 12, the center contact, when soldered, remains isolated from the legs 20, 22, 24, and 26, and the holes 60, 62, 64, and 66 in the printed circuit board 28. This isolation is necessary in order to preserve the coaxial relationship between the center contact and the body portion 12, the center contact 16 carrying the signal, and the body portion 12 being ground.

The necessary isolation is established by the pads 50, 52, 54, and 56 which keep the body portion 12 and the flange 18 spaced from the surface of the printed circuit board 28. The pads fulfill this purpose by preventing the body portion 12, the flange 18, or the dielectric 14 from coming near or contacting the region of the circuit board surrounding the center contact 16. The dielectric separating the body portion 12 and the flange 18 is air. The pads also provide the added advantage that a strip line on the upper surface of the printed circuit board can run to the center contact without touching the grounded body portions.

Figure 2:
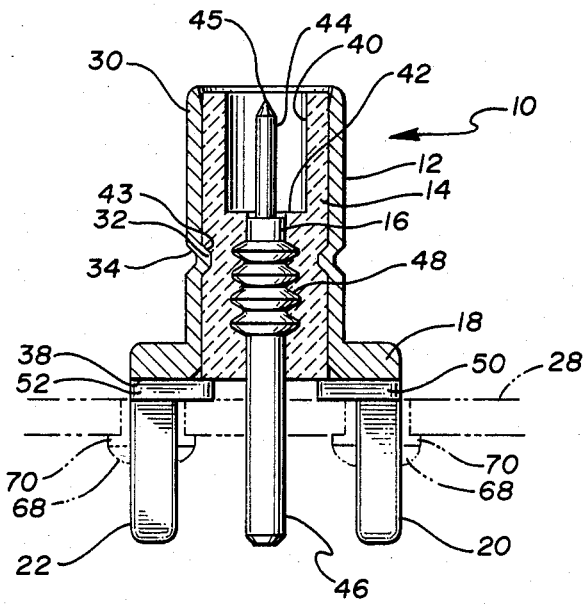
FIG. 2 is a sectional view taken along line 2—2 of FIG. 1.
Figure 3:
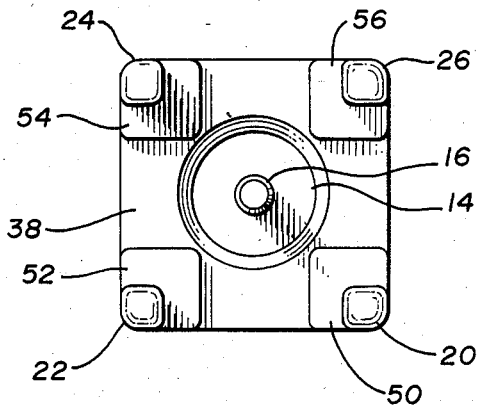
FIG. 3 is a bottom view of the interface.

Looking now to the upper portion of the contact 10, it is seen in FIG. 2 that the dielectric 14 is held within the body portion 12 by the annular ring 32 at roughly the midpoint of the body portion 12. The annular ring 32 fits into the groove 43 in the dielectric 14 and prevents the dielectric 14 from upwardly and downwardly movement.

The upper portion of the interface 10 is suitable for connection to a standard SMB coaxial mating connector. A female receptacle on such a compatible mating connector (not shown) makes contact with the center contact 16 to transfer the signal traveling down a center conductor of a coaxial cable from the cable to the strip line conductor on the printed circuit board. The signal is transferred in complete isolation from the grounded portion of the connector 10 and from the ground plane of the printed circuit board 28. The grounded portion of a compatible mating connector (not shown) fits over the outer wall 30 of the body portion 12 and makes contact with the groove 34 to hold the compatible mating connector and the interface 10 together. It is to be kept in mind that the type of connection herein presented is of the standard SMB type.

The connector 10, because of the use of the pads 50, 52, 54, and 56 does not require an insulating washer between the body portion 12 and the printed circuit board 28 which provides insulation between the different conductors of the interface 10. The isolation is provided by the air gap between the body portion 12 and the flange 18, and the printed circuit board 28. In addition, the gap between these parts allows solder flux to be washed out from under the connector 10 after a wave solder process, thereby avoiding the danger that corrosion will damage the connection and destroy the performance of the coaxial connector and the equipment attached thereto.

Having thus described my invention, it will be obvious to those skilled in the art that certain variations can be made such as those to the shape and size of the body portion, the flange, the pads, the legs, the dielectric, or the center contact. Each such modification or variation is intended to be within the scope and the intendment of the appended claims.

I claim:

1. A coaxial connector interface for a printed circuit board, said circuit board including structure defining a plurality of connector-receiving holes therein, comprising:

a hollow conductive body portion having an upper end and a lower end and defining a body portion inner diameter;

a dielectric disposed in the body portion and extending substantially from the upper end to the lower end;

an electrically conducting center contact disposed in the dielectric and extending from a point between the upper end and the lower end to a point beyond the lower end, the center contact having a midportion comprising a plurality of radially extending flanges defining a plurality of ribs and at least one groove along said center contact mid portion, said dielectric abutting against said ribs and received within said groove whereby the center contact is fixedly positioned in the dielectric;

a flange extending outwardly from and surrounding the lower end, the flange having a peripheral edge, a lower surface including structure defining an aperture in the center of said lower surface, said aperture having an aperture diameter generally coextensive with said body portion inner diameter, and a plurality of legs depending from said peripheral edge; and a plurality of pads depending from the lower surface of the flange, each pad extending along said flange lower surface from said flange peripheral edge and radially inwardly to a point immediately adjacent said aperture, whereby when the legs and center contact are extended through said connector-receiving holes in the printed circuit board the body portion and the flange are held in a spaced apart relationship from the circuit board to isolate the body portion from the center contact.

2. The invention as recited in claim 1, further comprising structure defining a circular retaining groove around the circumference of the body portion and located roughly midway between the upper end and the lower end.

3. The invention as recited in claim 1, further comprising an annular ring about the interior of the body portion and located roughly midway between the upper end and the lower end that prevents the dielectric from moving upwardly or downwardly within the body portion.

4. The invention as recited in claim 1, wherein the flange is square and has four legs, one extending from each of the four corners of the flange.

5. The invention as recited in claim 1, wherein the body portion, the flange, the legs, and the pads are integrally molded.

* * * * *